US006094012A

United States Patent [19]

Leung et al.

[11] Patent Number: 6,094,012

[45] Date of Patent: Jul. 25, 2000

[54] LOW ENERGY SPREAD ION SOURCE WITH A COAXIAL MAGNETIC FILTER

[75] Inventors: Ka-Ngo Leung, Hercules; Yung-Hee Yvette Lee, Berkeley, both of Calif.

[73] Assignee: The Regents of the University of California, Oakland, Calif.

[21] Appl. No.: 09/187,540

[22] Filed: Nov. 6, 1998

Related U.S. Application Data

[60] Provisional application No. 60/081,366, Apr. 10, 1998.

[51] Int. Cl.[7] ..... H01J 27/02

[52] U.S. Cl. ..... 315/111.81; 315/111.91; 315/111.71; 250/423 R

[58] Field of Search ..... 315/111.71, 111.81, 315/111.91; 250/423 R

[56] References Cited

U.S. PATENT DOCUMENTS

| | | | |
|---|---|---|---|
| 4,447,732 | 5/1984 | Leung et al. . | |
| 4,793,961 | 12/1988 | Ehlers et al. . | |
| 5,198,677 | 3/1993 | Leung et al. . | |
| 5,292,370 | 3/1994 | Tsai et al. | 118/723 MP |
| 5,703,375 | 12/1997 | Chen et al. | 250/492.21 |

FOREIGN PATENT DOCUMENTS 5-159894 6/1993 Japan .

*Primary Examiner*—Justin P. Bettendorf
*Attorney, Agent, or Firm*—Henry P. Sartorio

[57] ABSTRACT

Multicusp ion sources are capable of producing ions with low axial energy spread which are necessary in applications such as ion projection lithography (IPL) and radioactive ion beam production. The addition of a radially extending magnetic filter consisting of a pair of permanent magnets to the multicusp source reduces the energy spread considerably due to the improvement in the uniformity of the axial plasma potential distribution in the discharge region. A coaxial multicusp ion source designed to further reduce the energy spread utilizes a cylindrical magnetic filter to achieve a more uniform axial plasma potential distribution. The coaxial magnetic filter divides the source chamber into an outer annular discharge region in which the plasma is produced and a coaxial inner ion extraction region into which the ions radially diffuse but from which ionizing electrons are excluded. The energy spread in the coaxial source has been measured to be 0.6 eV. Unlike other ion sources, the coaxial source has the capability of adjusting the radial plasma potential distribution and therefore the transverse ion temperature (or beam emittance).

20 Claims, 8 Drawing Sheets

LOW ENERGY SPREAD ION SOURCE WITH A COAXIAL MAGNETIC FILTER

This application claims priority of Provisional Application Ser. No. 60/081,366 filed Apr. 10, 1998. +gi The United States Government has rights in this invention pursuant to Contract No. DE-AC03-76SF00098 between the United States Department of Energy and the University of California.

BACKGROUND OF THE INVENTION

The invention relates to ion sources and more particularly to multicusp ion sources.

In many applications, an ion source that can provide low longitudinal (axial) energy spread is required. Ion Projection Lithography (IPL) aims at projecting sub-0.1 $\mu$m patterns from a stencil mask onto a wafer substrate. In order to keep the chromatic aberrations below 25 nm, an ion source which delivers a beam with an energy spread of less that 3 eV is required. In the production of radioactive ion beams for nuclear physics experiments, an ion source with axial energy spread less than 1 eV is needed to perform isobaric separation with a magnetic deflection spectrometer. In low energy (<100 eV) ion beam deposition processes, very low energy spread is required in order to separate and focus the ions properly. Low energy (<500 eV) mass spectrometers for analyzing nuclear and chemical waste need an ion source that has low longitudinal energy spread to achieve good mass resolution.

An ion source is a plasma generator from which beams of ions can be extracted. A multicusp ion source has an arrangement of magnets that form magnetic cusp fields to contain the plasma. The plasma generating source is surrounded by columns of permanent magnets. The magnets are placed around the cylindrical side wall as well as an end flange. In most cases an extraction system is placed at an open end. Such magnet placement results in an asymmetric distribution of the plasma potential inside the source which produces an axial or longitudinal energy spread.

U.S. Pat. No. 4,793,961 issued Dec. 27, 1988 to Ehlers et al. describes a multicusp ion source.

A multicusp ion source is needed which can provide a low longitudinal or axial energy spread for many applications. This is especially true when ion beams must be transported, manipulated, analyzed and applied in very low energy applications.

The ions and electrons in a plasma are charged particles in motion and experience an interaction with a magnetic field. The ions and electrons move in orbits around the magnetic field lines and, apart from collisions with other plasma particles, act as though they are tied to the field lines. The behavior of a plasma in a magnetic field can be profoundly different from a plasma in the absence of a magnetic field.

The change in direction of motion of ions and electrons in the presence of a magnetic field provides a means of confining the plasma, at least in the direction transverse to the field. Plasma loss along the field can be reduced by increasing the field strength at the ends of the confinement region. The multicusp ion source uses this principle to successfully generate and confine the plasma.

Multicusp fields have three important effects on low-pressure plasma discharges. High energy electrons can be efficiently confined. These electrons can be the ionization source for a discharge. Significant improvements can be obtained in the confinement of the bulk plasma in a discharge. Significant improvements in radial plasma density and potential uniformity can be achieved.

Plasma can be generated in a multicusp ion source by dc discharge or RF induction discharge. The surface magnetic field generated by rows of permanent magnets, typically of samarium-cobalt, can confine the primary ionizing electrons very efficiently. As a result, the ionization efficiency of this type of plasma generator is high.

In the case of dc discharge, the primary ionizing electrons are normally emitted from hot tungsten-filament cathodes. The source chamber walls form the anode for the discharge. There are three main components in the source: the cathode, the anode, and the first or plasma electrode. Two dc power supplies are needed to produce plasma by means of a dc filament discharge. One is for filament heating (the heater power supply) and the other is for the discharge (the discharge power supply). The discharge or arc voltage usually ranges from 40 to 100 V.

There are two ways in which a low pressure gas can be excited by RF voltages: (1) a discharge between two parallel plates across which an alternating potential is applied (capacitively coupled discharge), and (2) a discharge generated by an induction coil (inductively coupled discharge). Most RF-driven ion sources are operated with the second type of discharge. A few hundred watts of RF power is typically required to establish a suitable discharge. The RF frequency can vary from a megahertz to tens of megahertz.

In the plasma source, the ions are generated in a discharge chamber. From that point of generation they drift until a fraction of them reaches the extraction region.

A radially extending magnetic filter system installed in the source chamber divides the chamber into two axially separated regions: (1) the discharge or source chamber or region, where the plasma is formed and contains the energetic ionizing electrons, and (2) the extraction chamber or region where a plasma with colder electrons is found. The filter provides a limited region of transverse magnetic field, which is made strong enough to prevent the energetic electrons in the discharge chamber from crossing over into the extraction chamber.

U.S. Pat. Nos. 4,447,732 and 5,198,677 issued May 8, 1984 and Mar. 30, 1993 to Leung et al. show a multicusp ion source with a radially extending magnetic filter formed of two or more parallel magnets in a plane perpendicular to the beam axis.

A multicusp source equipped with a prior art magnetic filter can reduce the energy spread substantially. The axial plasma potential ($V_p$) is different when the ion source is operated without and with a magnetic filter. Without the filter, $V_p$ decreases monotonically towards the plasma electrode. Positive ions formed on one side of the maximum can roll down and reach the extractor. Since the ions are generated at positions with different plasma potential, they will have a spread in axial energy when they arrive at the extraction aperture.

In the presence of a filter, the plasma potential distribution is very uniform in the discharge chamber region. Primary electrons emitted from a filament cathode are confined in the source chamber by the filter magnet fields as well as the multicusp fields on the chamber walls. Only very cold plasma electrons are present in the extraction chamber. The potential gradient in this region produces no effect on the axial ion energy spread. Since all the positive ions are produced within the source chamber region, they arrive at the plasma electrode with about the same energy due to the uniform $V_p$ distribution, or at most with energy spread given by the smaller potential drop between the center and the filter (~30 Gauss) region. One therefore expects that the longitudinal energy spread of the ions should be reduced.

Without the filter, the energy spread is found to be ~5 eV. In the presence of the prior art radially extending filter, this energy spread is reduced to about 1 eV. However, the lowest energy spread that one can achieve should be approximately equal to the thermal energy of the ions, e.g. less than 0.1 eV for helium ions. Thus an improved magnetic field which produces axial energy spread <1 eV is desired.

SUMMARY OF THE INVENTION

Accordingly, it is an object of the invention to provide a multicusp ion source with an improved magnetic filter.

It is also an object of the invention to provide a multicusp ion source which can produce ions with an axial energy spread of less than 1 eV.

In order to further reduce the energy spread of the ions according to the invention, one cannot extract the ions in the longitudinal (or axial) direction. Instead, one should extract the ions in the radial direction. The invention is a new multicusp ion source configuration with coaxial magnetic filter which meets the above requirement. A magnetic filter (cage) formed of a plurality of spaced parallel magnetic filter rods is mounted within thc ion source chamber, coaxial with the ion beam axis. The filter divides the chamber into two regions or chambers: an outer annular source region, and an inner central extraction region. The plasma is formed by filament dc discharge or rf induction discharge in the outer chamber. The plasma (positive ions and cold electrons) will diffuse radially into the central region. The plasma potential is uniform in the axial direction and there is no ion production in this inner chamber region. As a result, the axial energy spread should approach the thermal energy of the ions. Thc radial drop of the plasma potential $V_p$ can be adjusted by varying the bias voltage $V_b$ between the anodes of the two chambers. One can therefore eliminate a large energy spread in the radial direction. Ion beams with axial energy spreads of less than 1 eV can be achieved.

DETAILED DESCRIPTION OF THE INVENTION

Figure 1:
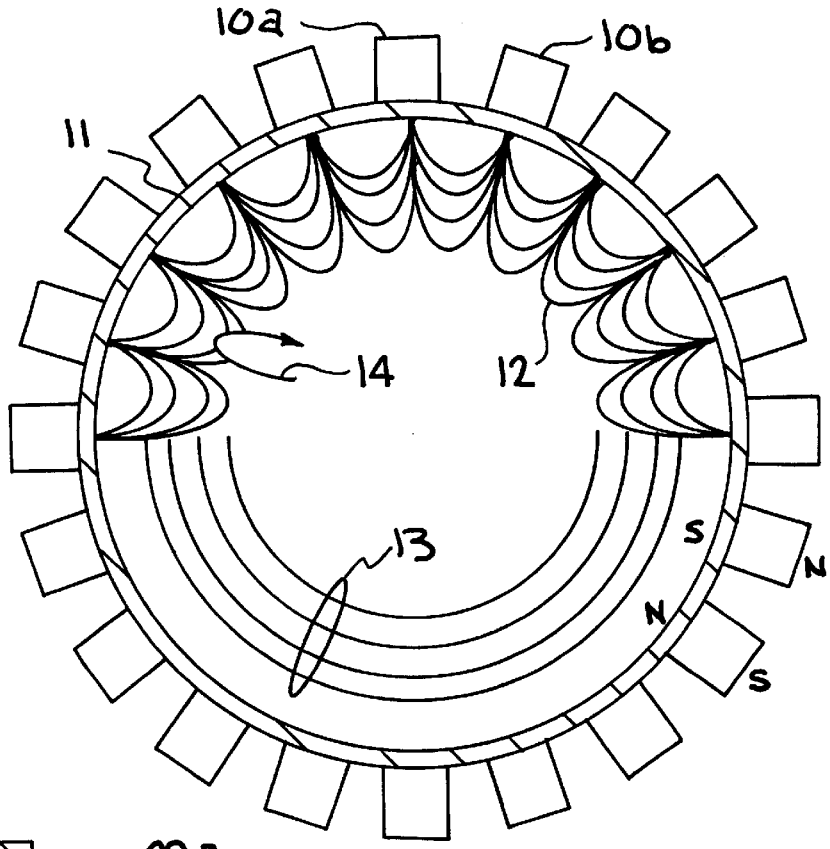
FIG. 1 (PRIOR ART)
FIG. 1 illustrates the magnetic cusp fields in a multicusp ion source.

Multicusp ion sources use permanent magnets to confine the primary ionizing electrons and plasma. The magnets 10*a*, 10*b*, etc., are arranged with alternating polarity around a cylindrical chamber 11 to generate line-cusp magnetic fields 12, as shown in FIG. 1. The magnetic field strength B is a maximum near the magnets and decays with distance into the chamber as represented by constant field strength contours 13. Most of the plasma volume can be virtually magnetic-field free, while a strong field can exist near the discharge wall, inhibiting plasma loss as indicated by ion trajectories 14 and leading to an increase in plasma density and uniformity.

Figure 2A:
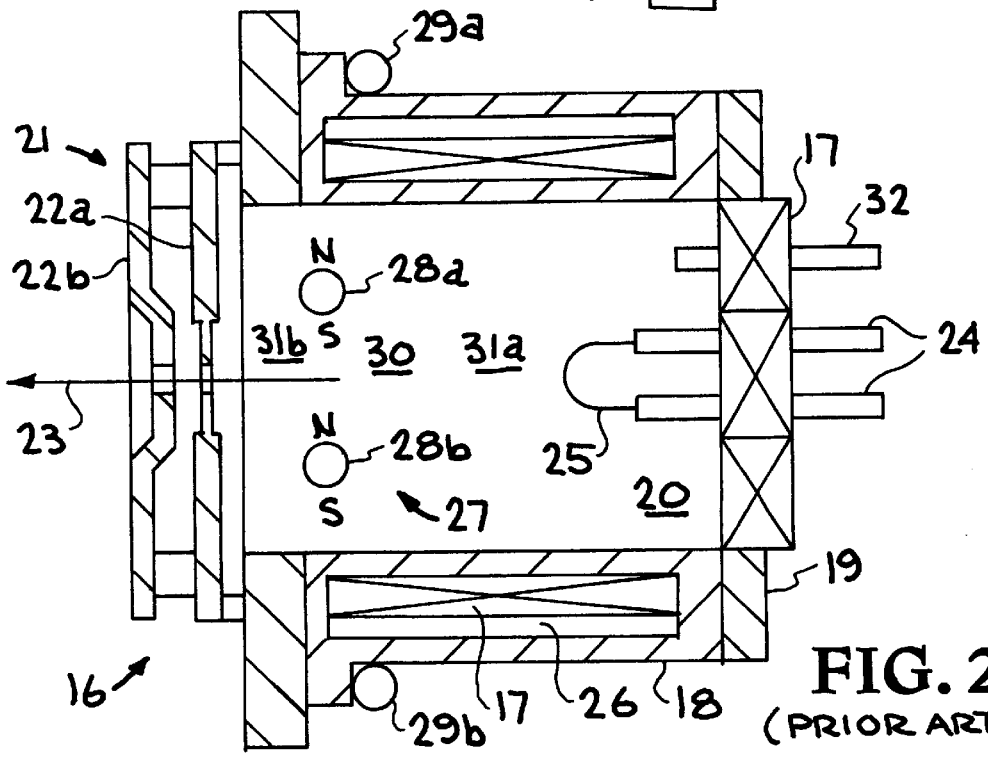
FIG. 2A (PRIOR ART)
FIGS. 2A, B show respective prior art dc discharge and RF driven multicusp ion sources with radially extending magnetic filter.

A prior art filament discharge multicusp source 16 is shown in FIG. 2A. Source 16 has an internal chamber 20. The permanent magnets 17 can be arranged around the lateral (typically cylindrical) wall 18 in rows parallel to the beam axis 23. Alternatively, they can be arranged in the form of rings perpendicular to the beam axis 23. The back plate 19 also contains rows of the same permanent magnets 17. Filament feedthroughs 24 in back plate 19 also provide for mounting a (tungsten) filament (cathode) 25 in chamber 20. Water jackets 26 may also be provided in lateral wall 18 for cooling. Gas inlet 32 in back plate 19 allows a gas to be introduced from which the ions are produced.

The open end of the ion source chamber 20 is closed by extractor 21 formed of a set of extraction electrodes 22*a, b* which contain central apertures through which the ion beam can pass. The source 16 can be operated with the first or plasma electrode 22*a* electrically floating or connected to the negative terminal of the cathode 25. The plasma density in the source, and therefore the extracted beam current depends on the magnet geometry, the discharge voltage and current, the biasing voltage on the first extraction electrode, and the size of the source chamber.

A permanent magnet filter 27 formed of a spaced pair of magnets 28*a, b* of opposite polarity can be installed in the multicusp source 16. Filter 27 extends radially i.e. the magnets 28*a, b* are in a plane that extends radially across the chamber, dividing the source chamber 20 into two axially separated regions, discharge region 31*a* and extraction region 31*b*. Filament 25 is in discharge region 31*a* while extraction region 31*b* is adjacent extractor 21. The filter 27 improves the atomic ion fraction, the source operability, the plasma density profile at the extraction plane, and the uniformity of the plasma potential along the axis.

Filter 27, generated either by inserting small magnets 28*a, b* into the source chamber 20 or by installing a pair of dipole magnets 29*a, b* on the external surface of the source chamber, provides a narrow region 30 of transverse B-field that is strong enough to prevent the energetic ionizing electrons produced by filament 25 from reaching the extraction region 31*b*, but is weak enough to allow the plasma formed in discharge region 31*a* to leak through. The absence of energetic electrons will prevent the formation of molecular ions in the extraction region, but dissociation of the molecular ions can still occur. As a result, the atomic ion species percentage in the extracted beam is enhanced.

Figure 2B:
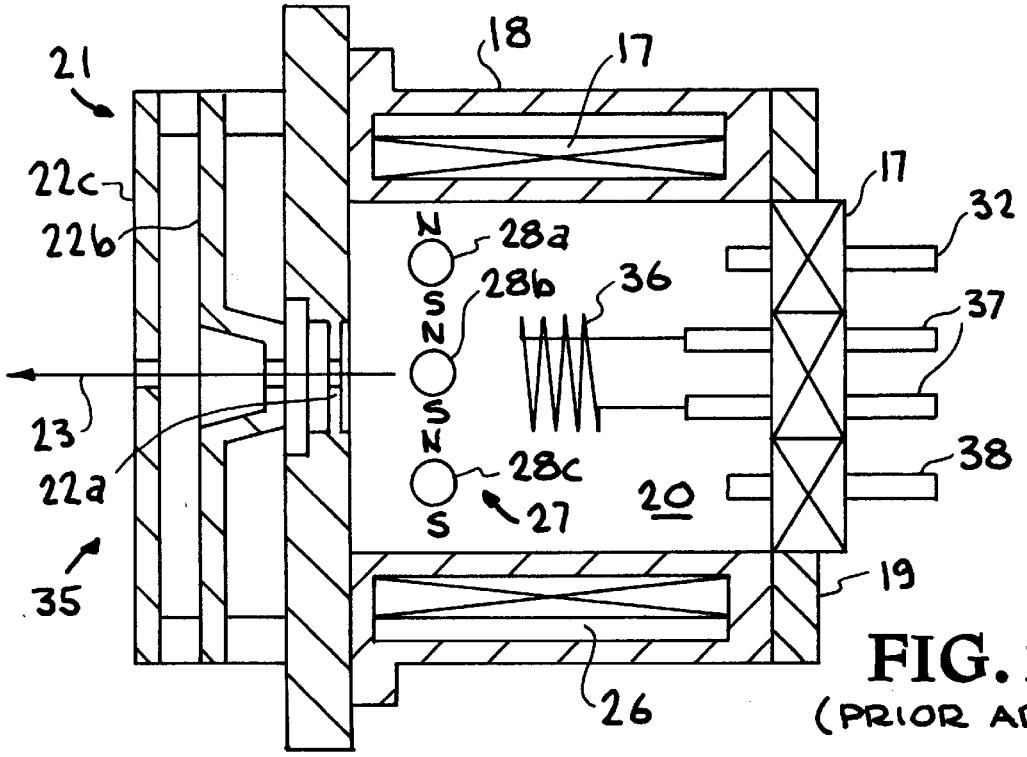
FIG. 2B (PRIOR ART)

FIG. 2B shows an RF-driven ion source 35 which is substantially similar to ion source 16 of FIG. 2A. The major difference is that an RF discharge is generated by placing an induction coil (RF antenna) 36 inside the source through feedthroughs 37. An azimuthal electric field is generated by the alternating magnetic field in the discharge region. Electrons present in the gas volume are accelerated by the induced electric field. They quickly acquire enough kinetic energy to form a plasma by ionizing the background gas particles. The ions are then extracted from the source chamber by extractor 21 (shown as having a first or plasma electrode 22*a* and two other electrodes 22*b, c*) in a manner similar to a dc discharge source. The remainder of the structure is the same as described for ion source 16, and the same reference numerals are used for similar elements. In particular, a radially extending magnetic filter 27 formed of three magnets 28*a, b, c* is positioned in chamber 20 near the extractor 21. (Filter 27 can be formed of two or more magnets.) Also a quartz light pipe 38 passing through back plate 19 can be used to visually inspect chamber 20.

Figure 3A:
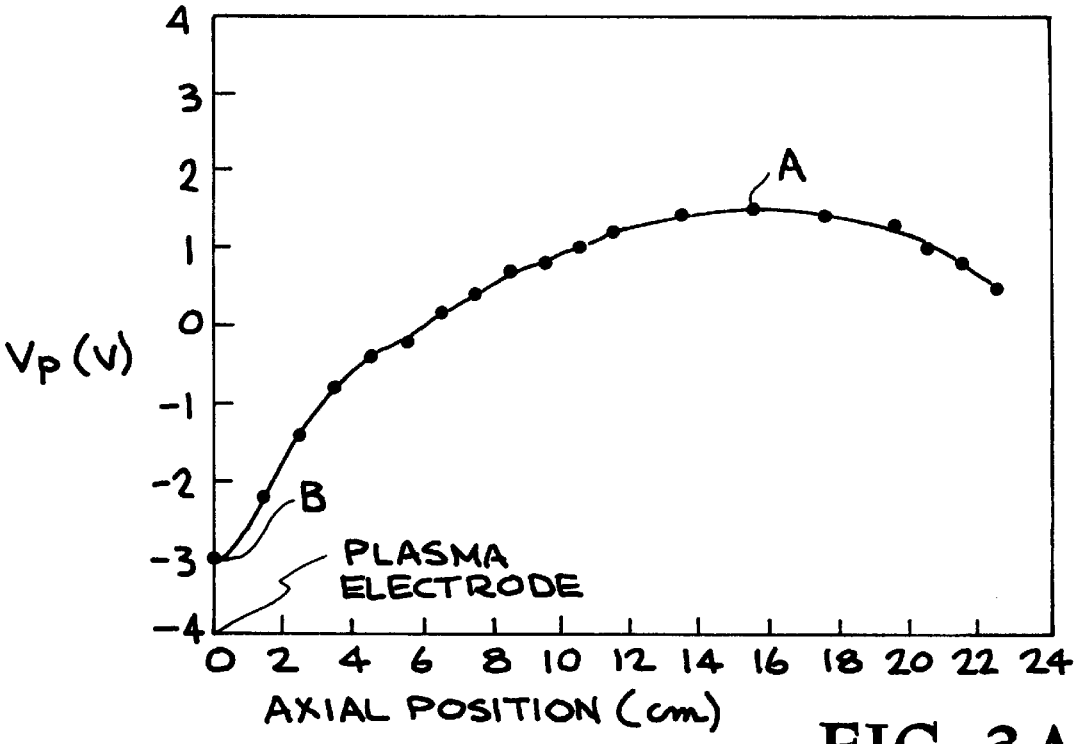
FIGS. 3A, B show the axial plasma potential profile inside the source of FIG. 2A without and with the magnetic filter, respectively.

The axial plasma potential ($V_p$) profile inside the source (without filter) on axis as a function of the axial position is shown in FIG. 3A. The plasma potential decreases monotonically towards the plasma electrode. A and B are the maximum and minimum plasma potential values, where ions can be born, i.e. ionization takes place. Ions formed at position A have more potential energy than ions generated in position B, given by the difference in potential between the two points. Positive ions generated at high $V_p$ will reach the extractor as well as the ions created at lower potentials. Since the ions are generated at positions with different plasma potential, they will have a spread in axial energy when they arrive at the extraction aperture.

Figure 3B:
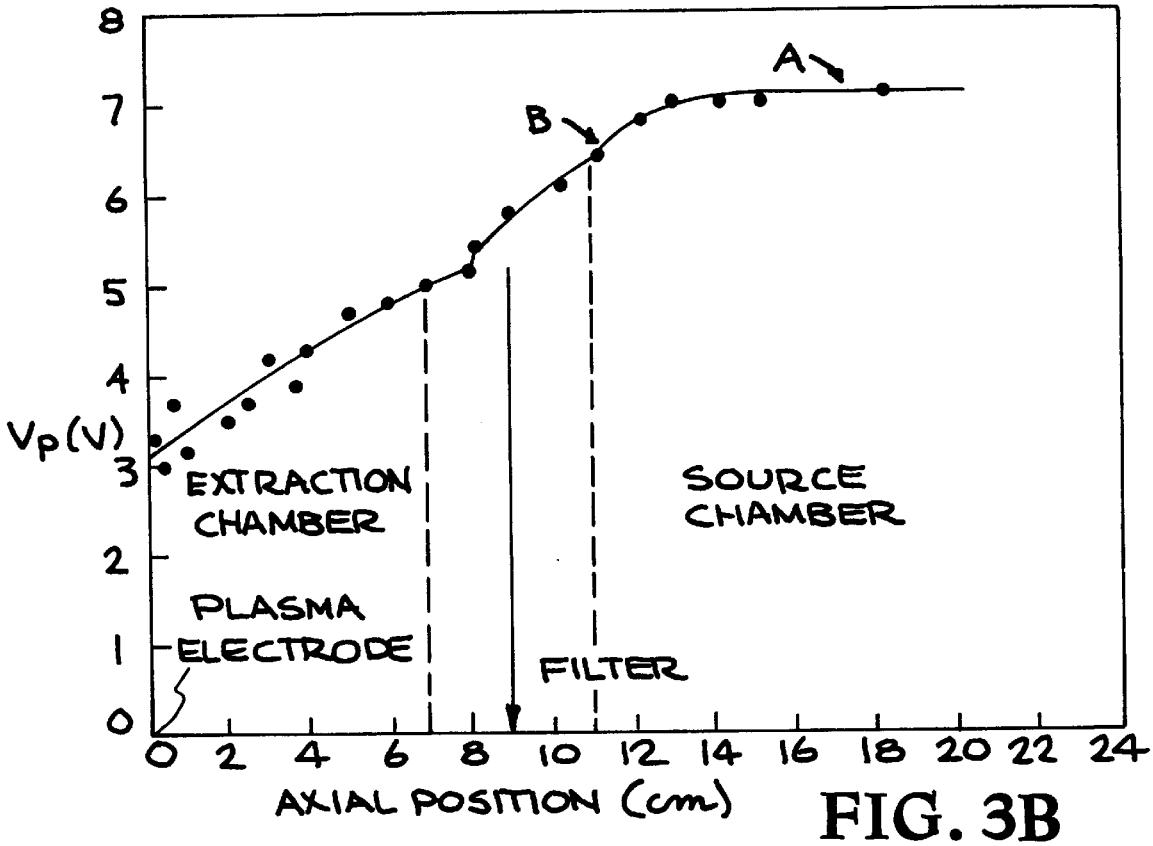
FIG. 3C shows the measured radial plasma density profile for a multicusp ion source.

One way to level the plasma potential is by introducing a pair of filter magnets inside the source chamber, as shown in FIGS. 2A, B. The filter creates a region with a relatively uniform $V_p$ profile in the discharge chamber region, as shown in FIG. 3B. (The potential difference between A and B is only about 0.5 V in FIG. 3B compared to about 4.5 V in FIG. 3A.)

Primary electrons emitted from the filament cathode are confined in the discharge region of the source chamber by the filter's magnetic fields as well as the multicusp fields on the chamber walls. The potential gradient in the extraction region produces no effect on the energy spread. Since all the positive ions are produced within the source chamber discharge region, they arrive at the plasma electrode with about the same energy due to the uniform $V_p$ distribution. However, there is still a small potential gradient, given by the potential difference between point A and B (in FIG. 3B, less than 1V), between the center and the filter (~80 Gauss) region that causes a small spread.

Figure 3C:
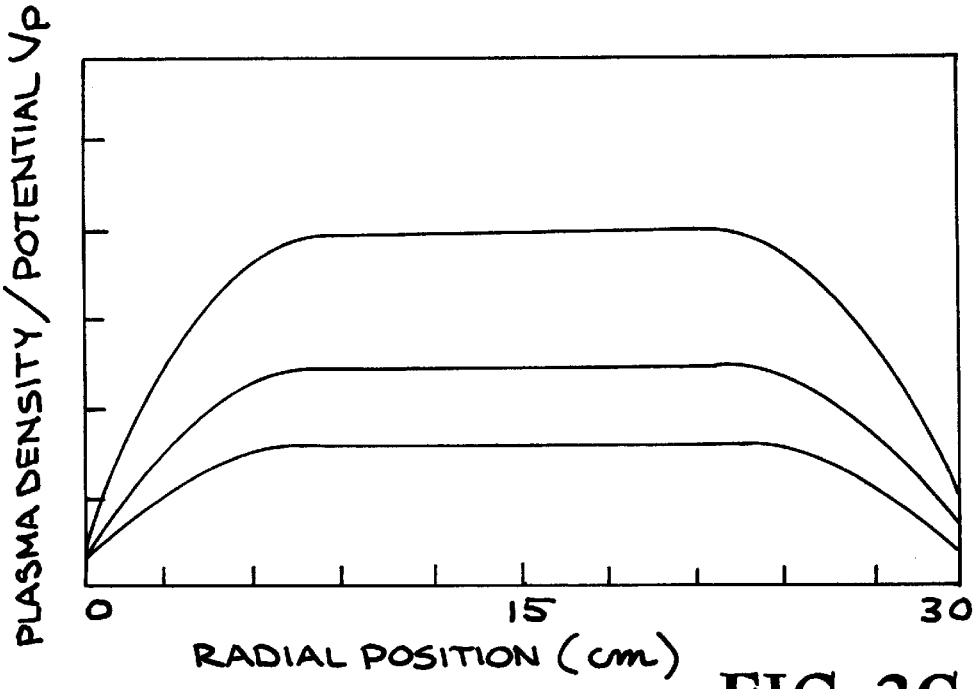

The measured radial plasma density profile, shown in FIG. 3C, for a 30 cm diameter multicusp generator is uniform at the center and quickly falls near the walls. The plasma potential $V_p$ has a similar radial distribution. This particular plasma density or potential distribution is due to the magnetic cusp field that confines the plasma efficiently.

The ion energy spread in the central uniform region is very small, and it should approach the thermal energy of the ions (<0.1 eV). This characteristic of the multicusp ion source can be utilized according to the invention to form ion beams with energy spreads lower than 1 eV. In order to extract the ions that are generated in the uniform region, a coaxial source geometry according to the invention is used. This new source configuration provides ions with very low axial energy spread.

FIGS. 4A–D show a coaxial source 40 which uses a conventional multicusp chamber 41 but with a new magnetic filter 42 which extends axially rather than radially. The filter 42 has a coaxial cage configuration with a plurality of (e.g. 6 or 12) permanent-magnet columns or filter rods 43. One or more filaments 53 extend into annular discharge region 44. Alternatively an RF antenna 54 is positioned in the annular discharge region. Plasma is generated in the annular discharge region 44 between the source chamber walls and the filter cage and diffuses into the central extraction region 45 inside the filter cage. The axial plasma potential ($V_p$ vs. x) of the annular region is uniform outside the cusp-field. Efficient plasma confinement and uniform plasma potential distribution are provided by permanent magnets 46 on the side walls as well as permanent magnets 47 on the back and front flanges. The radial plasma potential profile ($V_p$ vs. r) suffers a dip at the center or extraction region. Ions present in this region are generated at the discharge side of the source with approximately the same energy, and have diffused from the discharge region 44 to the central region 45. Since ions are not produced in the extraction region, the radial plasma potential distribution does not affect the axial energy spread. Ion extractor 21 formed of electrodes 22*a, b* (similar to FIG. 2A) is positioned to extract ions from central region 45.

Figure 4A:
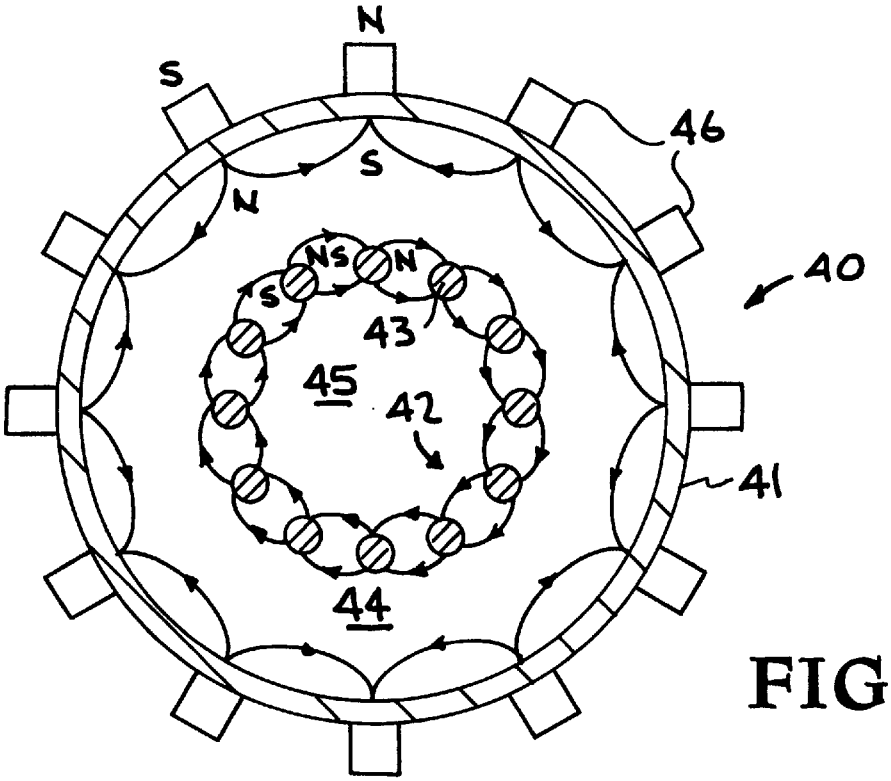
FIGS. 4A, B are radial and transverse views of a coaxial multicusp ion source according to the invention.
Figure 4B:
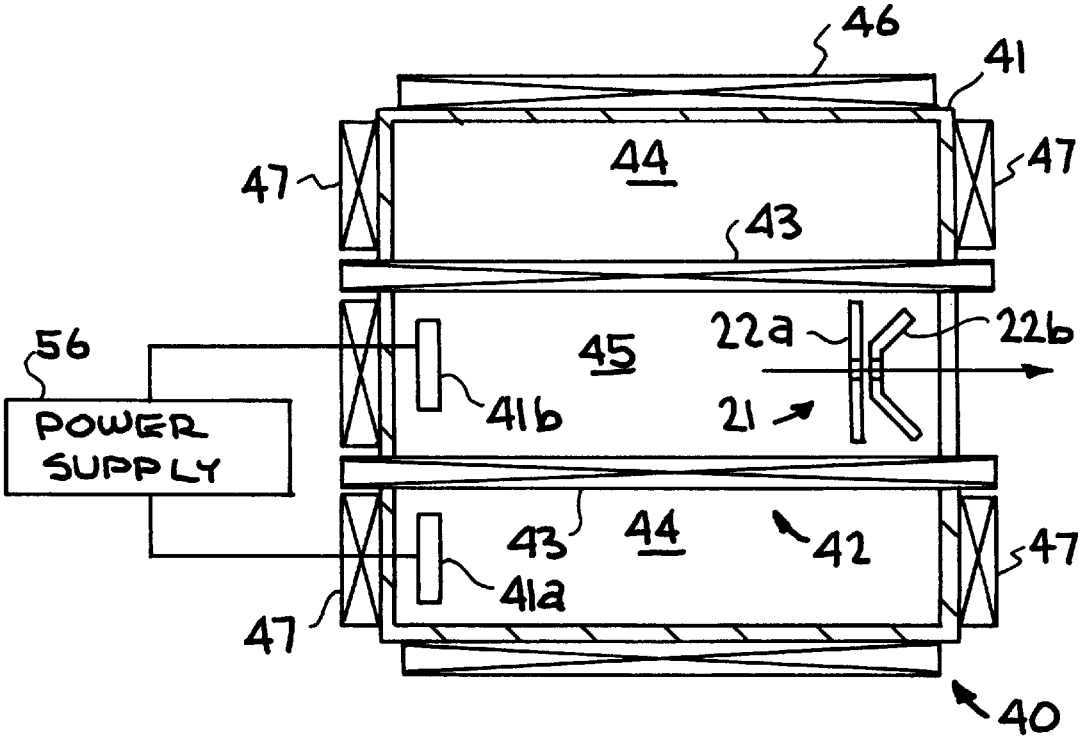
FIG. 4C, D are transverse views of the source of FIGS. 4 A, B showing the positions of filaments and an RF antenna respectively.
FIG. 4E shows the calculated field distribution in a coaxial multicusp ion source.
FIG. 4F is a perspective assembly view of a coaxial multicusp ion source.
FIG. 4G is a perspective view of the structure of a magnetic filter rod.
FIG. 4H is a cross section of a coaxial multicusp ion source with a bias plate.
Figure 4C:
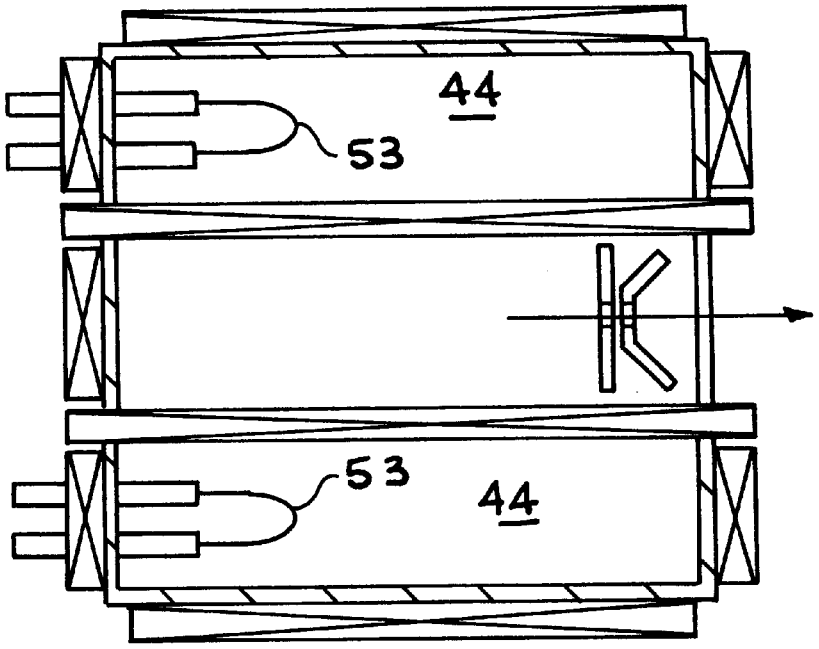
Figure 4D:
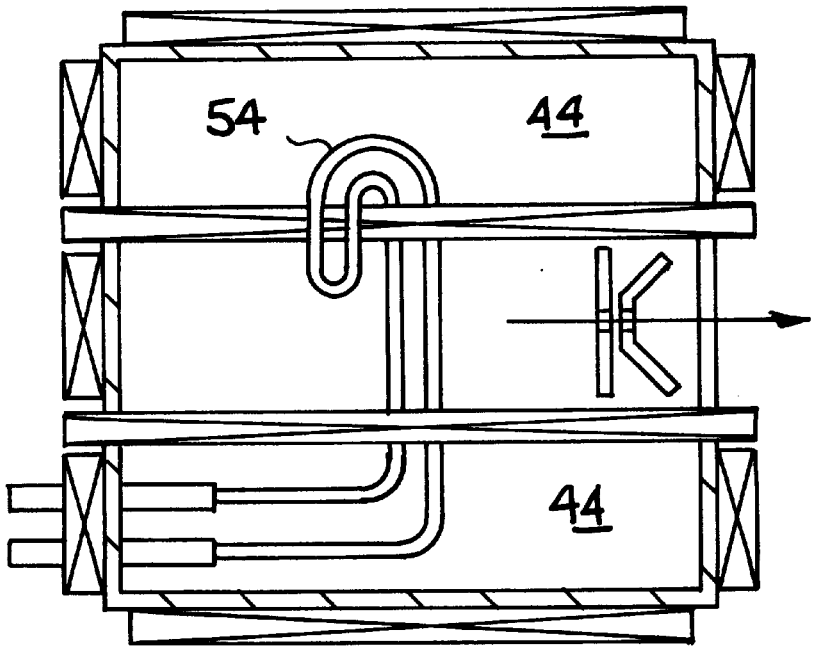
Figure 4E:
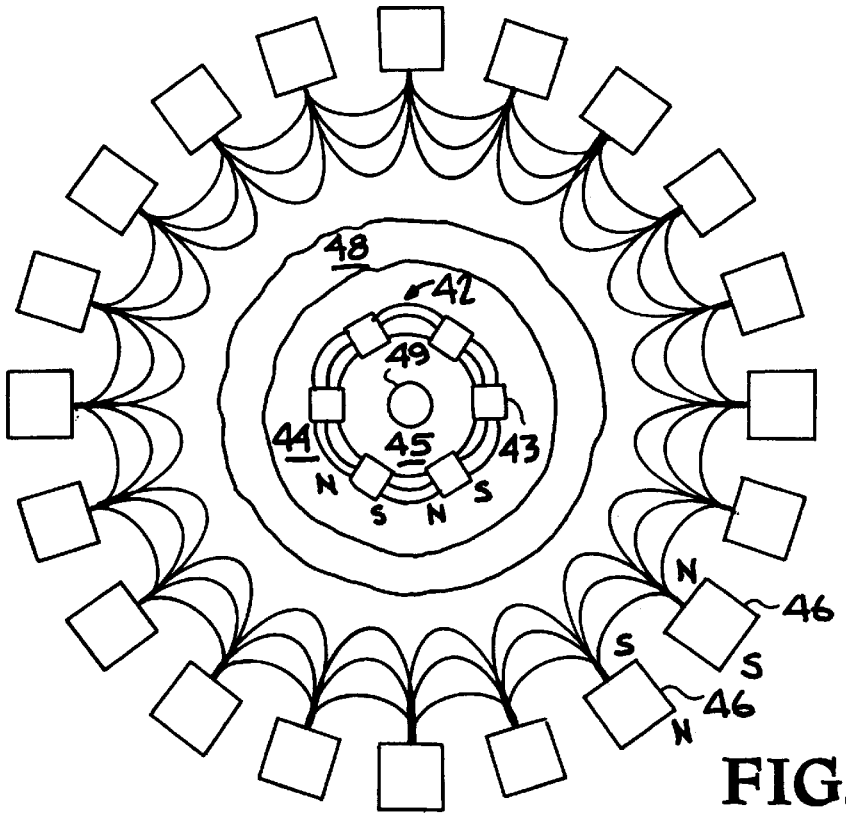

The field free region (<30 Gauss) in the center region 45 of the filter cage 42 as well as the annular region 44 is significant in the design since plasma is generated and extracted in these two regions respectively. FIG. 4E shows a field calculation using the computer code "Beefy" (available from Lawrence Berkeley National Laboratory, Berkeley, Calif.) for a multicusp source (20 cm diameter) with 20 columns of permanent magnets 46 surrounding the chamber. The magnets 46 are placed around the chamber body with alternating polarities to generate the cusp field (8900 Gauss, samarium-cobalt magnets). The magnetic filter 42 is designed with 6 permanent magnet columns or rods 43 (9000 Gauss, samarium-cobalt magnets). The positioning of these filter magnets 43 is different from the magnets 46 in the chamber wall. Regions 48, 49 in annular region 44 and central region 45 respectively are the field free regions.

Figure 4H:
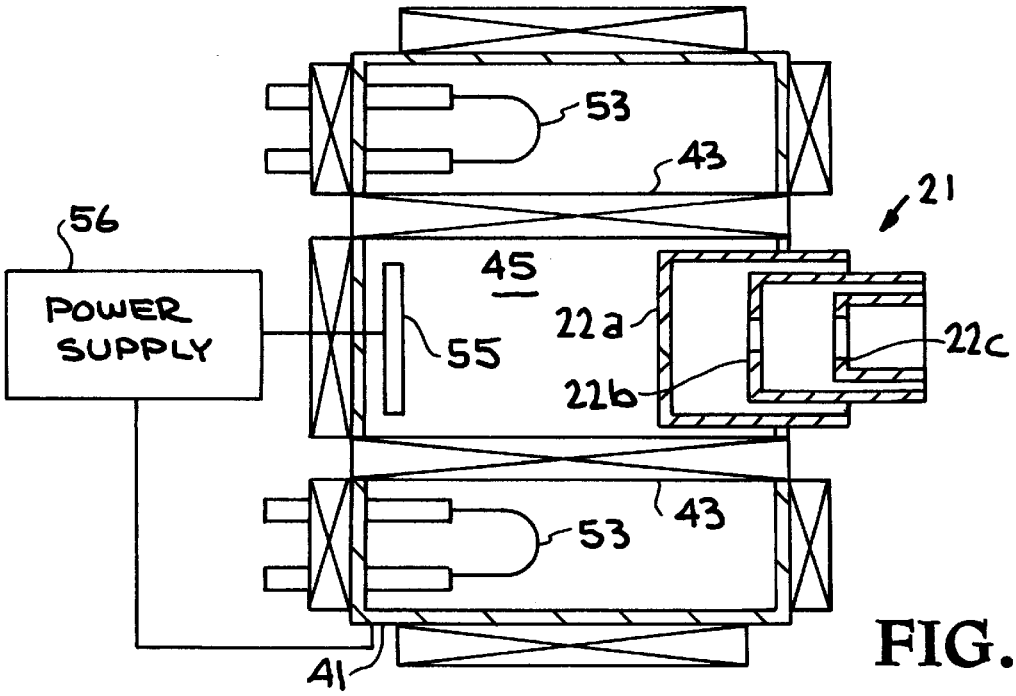
Figure 4G:
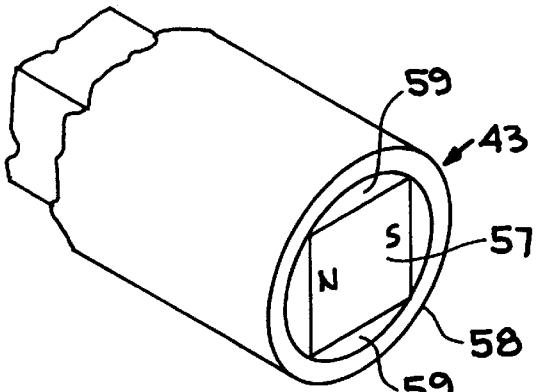
Figure 4F:
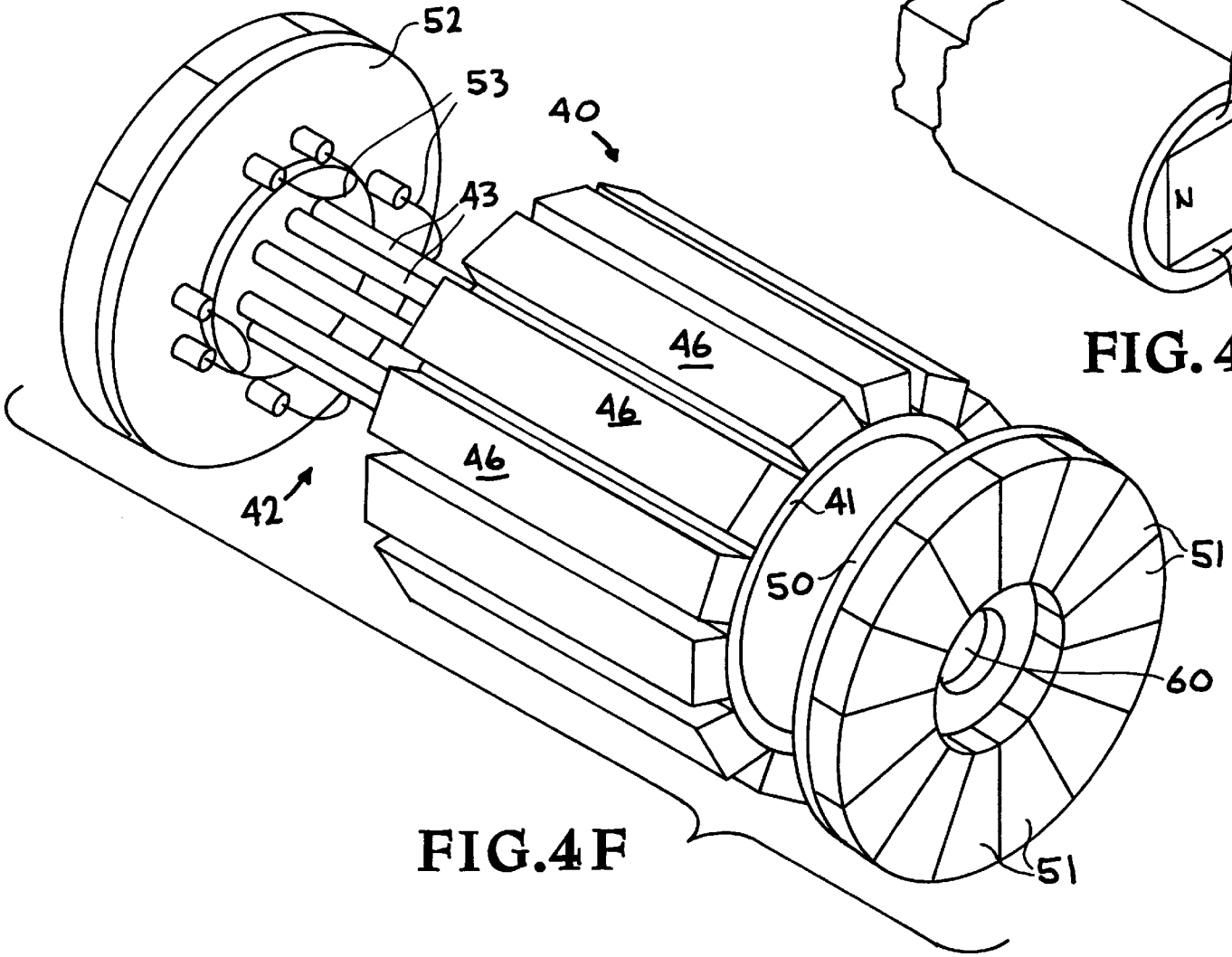

An illustrative coaxial source 40 as shown in FIG. 4F has 14 bars 46 of magnets surrounding a chamber 41 which contains a magnetic filter cage 42. The chamber 41 is copper-plated stainless steel 20-cm-diameter by 20 cm long. The front plate 50 has 14 magnets 51 placed radially. The back plate 52 has four rows of magnets. Four filaments 53 positioned outside the filter cage 42 can be used for plasma generation. Additional ports are provided on the back plate for placing the filter cage, gas line, etc. The chamber and the flanges or plates are water cooled. Front plate 50 contains a central aperture 60 through which ions are extracted.

The filter cage 42 is made out of copper tubing, as shown in FIG. 4G. Small samarium-cobalt magnets 47 are placed inside broached copper tubing 48 to form filter rods 43. Water is supplied through one of the openings and distributed through spaces 59 to cool the magnets 57.

A concern with the coaxial source is the nonuniformity of the radial plasma potential distribution. The transverse ion energy is suspected to be larger than the regular ion source configuration. A further improvement in performance can be obtained by biasing the anode 41*a* of central region 45 relative to the anode 41*b* of chamber 41 as shown in FIG. 4B. (In general, to the chamber itself and associated components mounted thereon, e.g. magnets, form the anode.) A portion 41*a* of chamber 41 can be electrically isolated from the rest of the chamber 41*b*. Power supply 56 provides a bias voltage. The central anode can also be formed by placing a small bias plate 55 in the center region 45, as shown in FIG. 4H. This plate is electrically isolated from the rest of the source. A dc power supply 56 is used to bias the plate 55 and the source chamber 41 in order to adjust the plasma potential distribution in the center region 45. Preliminary testing shows that the emittance is improved when the plate 55 is biased one or two volts more positive with respect to the source chamber 41.

Figure 5A:
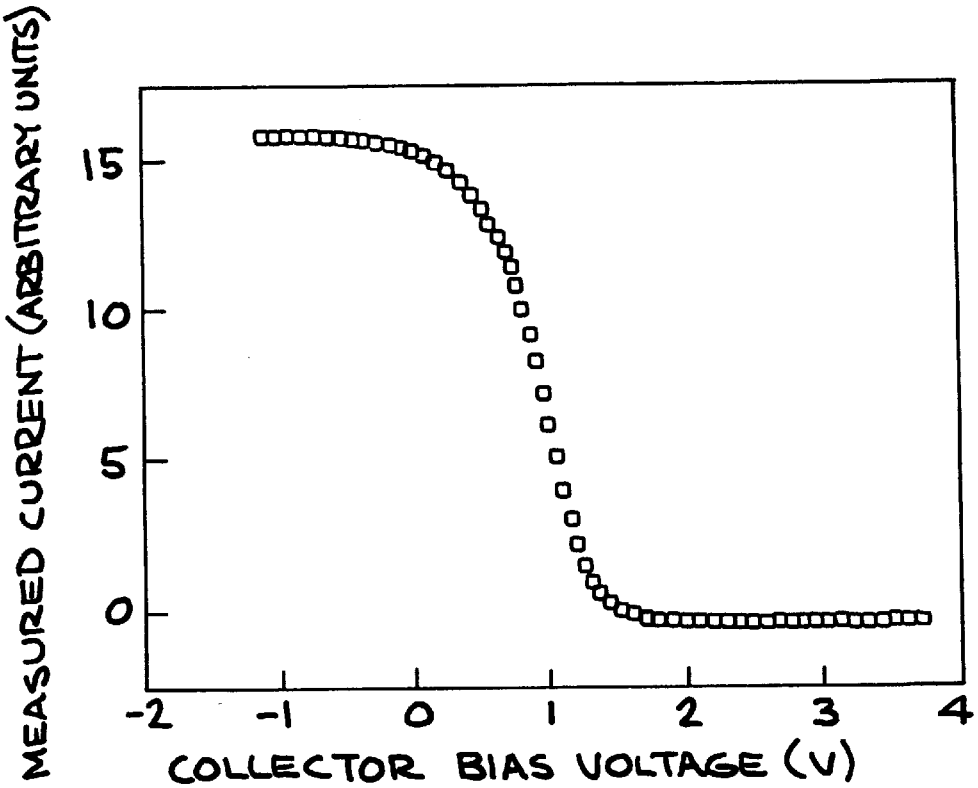
FIGS. 5A, B show the current-voltage (I-V) and energy spread (dI/dV vs. V) for a coaxial multicusp ion source.
Figure 5B:
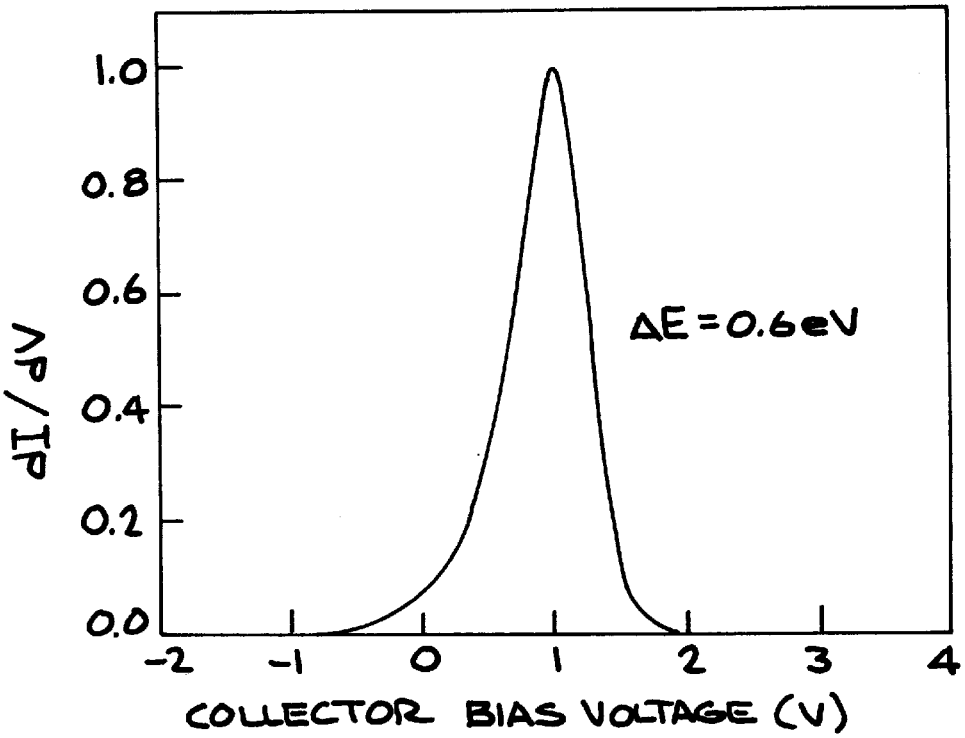

Using a weak magnetic filter cage, ($B_{max}$~50 Gauss), the coaxial source is found to have an average axial energy spread of less than 3 eV at a discharge power of 240 W, slightly increasing with increase in power. With a strong filter cage ($B_{max}$~250 Gauss) hydrogen ion energy spreads as low as 0.6 eV have been achieved. FIG. 5A shows the I-V curve for an ion source where ion current is measured as a function of collector grid bias voltage; at negative bias, all ions are collected, but at positive bias, only ions with energies greater than the bias voltage are collected. FIG. 5B shows the dI/dV vs. V curve; the full width at half maximum of the differentiated curve is the energy spread. The ion energy spread, ΔE, is approximately the same at different axial positions in the source. ΔE was measured at a discharge voltage of 80 V and discharge currents ranging from 1A to 4A at a fixed pressure of 3 mTorr; the energy spread is found to be <1 eV at different discharge conditions. Even at different gas pressures, ΔE remains below 1 eV.

The ion energy spread can be reduced below 1 eV by employing the coaxial source configuration of the invention. However, the filter strength must be properly optimized to achieve a low energy spread as well as reasonable extractable currents. Nevertheless, this new filter arrangement should not generate any fields at the extraction aperture to affect the ion optics.

Accordingly, multicusp ion sources with coaxial magnetic filters can produce ions with sufficiently low axial energy spread for applications such as ion projection lithography (IPL) and radioactive ion beam (RIB) production. Axial ion energy spread of both filament driven ion sources and rf-driven sources can be reduced below 1 eV using a coaxial source with a magnetic filter comprising a water-cooled filter cage with a plurality of rows of permanent magnets instead of a pair of radially disposed magnets.

The axial plasma potential distribution as well as the electron density in the discharge region for the coaxial source is quite uniform. Furthermore, the electron temperature in the extraction region of the source can be as low as 0.1 eV which adds a new dimension to the possible applications of the source. This electron temperature is lower than that of a tungsten cathode which normally operates at >3,000° C. (~0.3 eV). The brightness of the electron beam can be improved if the electron temperature is small. Thus, the coaxial source can also serve as a high brightness electron source for e-beam lithography. Instead of using thermal emission cathodes or laser induced photocathodes, high intensity electron beams can be extracted from the dense plasma inside the coaxial source.

The radial plasma potential distribution can be adjusted by biasing the anode of the central region with respect to that of the annular region using a bias plate. The beam emittance is reduced when the plate is biased slightly positive (~1V).

Changes and modifications in the specifically described embodiments can be carried out without departing from the scope of the invention which is intended to be limited only by the scope of the appended claims.

What is claimed is:

1. An ion source, comprising:

a multi-cusp plasma generator having a longitudinal axis and generating a plasma having a substantially uniform axial plasma potential along the longitudinal axis and a substantially uniform radial plasma potential perpendicular to the longitudinal axis;

a coaxial magnetic filter mounted in the plasma generator and extending along the longitudinal axis, wherein ions produced outside the magnetic filter pass through the filter and are extracted therefrom.

2. The ion source of claim 1 wherein the coaxial magnetic filter comprises a plurality of spaced parallel magnetic rods.

3. The ion source of claim 2 wherein the plasma generator comprises:

a chamber;

a plurality of permanent magnets disposed about the chamber to produce a magnetic cusp field therein;

a gas inlet in the chamber;

a plasma generating element in the chamber.

4. The ion source of claim 3 wherein the plasma generating element is a dc discharge filament or an RF induction coil antenna.

5. The ion source of claim 3 wherein the chamber is cylindrical.

6. The ion source of claim 3 wherein the magnetic filter divides the chamber into an annular outer region in which a plasma is produced and a coaxial inner region into which ions from the plasma radially diffuse, and from which ions are extracted.

7. The ion source of claim 6 further comprising an extractor mounted on an open end of the chamber to extract ions from the inner region of the chamber.

8. The ion source of claim 7 wherein the extractor comprises a pair of electrodes.

9. The ion source of claim 7 further comprising a bias plate mounted in the inner region the chamber for applying a bias voltage between the bias plate and the chamber.

10. An ion source, comprising:

a cylindrical chamber;

a plurality of parallel spaced columns of permanent magnets arrayed around the lateral surface of the chamber to produce a magnetic cusp field therein;

a back plate mounted on one end of the chamber;

a plurality of permanent magnets mounted on the back plate;

a front plate mounted on the other end of the chamber;

a plurality of permanent magnets mounted on the front plate;

a gas inlet in the back plate;

a plasma generating element mounted on the back plate;

a magnetic filter mounted coaxially in the chamber and separating the chamber into an outer annular plasma generating region and a coaxial inner ion extraction region, the plasma generating element extending into the outer plasma generating region;

an ion extractor mounted on the front plate and communicating with the inner ion extraction region.

11. The ion source of claim 10 wherein the coaxial magnetic filter comprises a plurality of spaced parallel magnetic rods.

12. The ion source of claim 10 wherein the plasma generating element is a dc discharge filament or an RF induction coil antenna.

13. The ion source of claim 10 wherein the ion extractor comprises at least a first electrode.

14. The ion source of claim 10 further comprising a bias plate mounted in the inner region of the chamber for applying a bias voltage between the bias plate and the chamber.

15. The ion source of claim 11 wherein the magnetic rods are formed of copper tubes and samarium-cobalt magnets inside the copper tubes.

16. The ion source of claim 11 wherein the magnetic filter produces a magnetic field of about 50–250 Gauss.

17. A method for generating an ion beam with a low energy spread from a multi-cusp ion source comprising:

producing a coaxially extending magnetic field within the multi-cusp ion source to divide the source into an outer region and coaxial inner region;

generating a plasma in the outer region, the plasma having a substantially uniform axial plasma potential and a substantially uniform radial plasma potential, the coaxially extending magnetic field allowing ions from the plasma to diffuse radially to the inner region while preventing ionizing electrons from entering the inner region from the outer region;

extracting ions from the inner region.

18. The method of claim 17 wherein the coaxially extending magnetic field is formed by mounting a coaxially extending magnetic filter formed of a plurality of spaced parallel permanent magnetic rods in the multicusp ion source.

19. The method of claim 17 wherein the coaxially extending magnetic field has a maximum value of about 50–250 Gauss.

20. The method of claim 17 wherein the plasma is generated by dc discharge or RF induction discharge.

* * * * *